United States Patent [19]

Niederer

[11] Patent Number: 4,858,839

[45] **Date of Patent: * Aug. 22, 1989**

[54] YARN TENSION CONTROL APPARATUS AND METHOD

[76] Inventor: Kurt W. Niederer, 3021 Mountainbrook Rd., Charlotte, N.C. 28210

[ * ] Notice: The portion of the term of this patent subsequent to Oct. 18, 2005 has been disclaimed.

[21] Appl. No.: 180,172

[22] Filed: Apr. 11, 1988

[51] Int. Cl.[4] ..... B65H 51/26; B65H 51/30

[52] U.S. Cl. ..... 242/47.09; 242/47.01

[58] Field of Search ..... 242/47.01, 47.08, 47.09, 242/47.1, 47.11, 47.12, 45, 18 R; 66/132 R, 132 T; 139/452

[56] References Cited

U.S. PATENT DOCUMENTS

| | | | |
|---|---|---|---|
| 1,849,983 | 3/1932 | Junkers | 242/47.09 |
| 2,350,182 | 5/1944 | Neff | 242/47.09 X |
| 2,476,281 | 5/1956 | Drisch et al. | 242/47.09 X |
| 2,641,913 | 6/1953 | Alric | 242/47.09 X |
| 2,819,582 | 1/1958 | Hill | 242/47.11 |
| 2,896,572 | 7/1959 | Burke | 242/47.09 X |
| 3,119,572 | 1/1964 | Tata | 242/47.09 |
| 3,194,276 | 7/1965 | Krukonis et al. | 242/47.01 X |
| 3,912,184 | 10/1975 | Bous | 242/47.09 X |
| 3,957,218 | 5/1976 | Coats et al. | 242/47.09 X |
| 4,545,543 | 10/1985 | Plucknett | 242/47.01 |
| 4,778,118 | 10/1988 | Niederer | 242/47.09 |

*Primary Examiner*—Stanley N. Gilreath

[57] ABSTRACT

A yarn tension control apparatus comprising a first feed roll having a substantial conically tapered yarn engaging roll surface, driven at a predetermined r.p.m., a second feed roll having a substantially conically tapered yarn engaging roll surface, the second feed roll positioned in spaced-apart relation with the first feed roll for receiving a yarn wrapped successively around a circumference defined collectively by opposed surfaces of the first and second rolls from a yarn infeed position axially along the first and second rolls to a yarn exit position. The first and second feed rolls are aligned relative to each other so that the collectively defined circumference any any point on the yarn engaging surfaces of the first and second rolls is greater than the collectively defined circumference in one direction along the axis of rotation of the rolls, and less than the collectively defined circumference in the other direction along the axis of rotation of the rolls. An elongate tension arm is positioned between and along the length of the first and second rolls and a plurality of yarn guides positioned in the tension arm along the length thereof for receiving successive wraps of yarn. The tension are moves along the length of the rolls in response to changes in tension of the yarn to a yarn infeed position or increased roll diameter in response to an increase in tension on the yarn and to a position of decreased roll diameter in response to a decrease in tension on the yarn.

10 Claims, 6 Drawing Sheets

YARN TENSION CONTROL APPARATUS AND METHOD

TECHNICAL FIELD AND BACKGROUND OF THE INVENTION

This invention relates to a yarn tension control apparatus and method. While the apparatus is adaptable to numerous uses and applications, the one discussed in this application for purposes of illustration is a yarn tensoin control apparatus which is used downstream of a yarn creel and upstream of an air jet entanglement texturizing machine. This type of machine is used to produce a soft, lustrous, fluffy yarn from "flat" multifilament continuous filament synthetic yarn. Tension control is crucial when supplying yard to such machines, since excessive tension greatly reduces the effectiveness of the air on the fibers in causing them to entangle and loop in the proper manner. The result is a yarn which is second quality and which in subsequent manufacturing processes manifests itself in flat and shiny spots or bands in woven or knitted goods, and in dye shade variations.

As usually supplied to the texturizing machine, flat yarn is subject to substantial yarn tension variation. These differences may be due to differences in package size, with small packages generating higher tension; yarn path differences; yarn guide alignment and wear, and the distance the yarn must travel. Generally, the tension in the yarn as it is delivered to the texturizing machine should be minimal, since the texturizing process itself overfeeds the yarn to a predetermined extent to cause looping and entanglement of the yarns.

Tension on synthetic flat yarn beyond a minimal amount exhibits itself in elongation of the yarn. By estimating the elongation of the yarn from the creel and determining the elongation desired immediately upstream of the texturizing machine, a percentage of "excess elongation" can be determined. The goal is, then, to reduce the tension and hence the elongation of the yarn in a reasonably predictable manner to a desired degree.

SUMMARY OF THE INVENTION

Therefore, it is an object of the invention to provide an apparatus for controlling yarn tension in a yarn processing operation.

It is another object of the invention to provide an apparatus for reducing yarn tension in advance of supplying the yarn to a texturizing machine, such as an air jet entanglement machine.

It is another object of the invention to provide an apparatus for reducing yarn tension which includes feedback means for regulating the degree to which tension is reduced in response to exit yarn tension to provide a constant output tension.

It is another object of the invention to provide an apparatus for reducing yarn tension which includes means for varying the range of tension to which the apparatus is responsive.

It is yet another object of the invention to provide a method of controlling or reducing yarn tension which may be performed with an apparatus according to this invention.

These and other objects of the present invention are achieved in the preferred embodiments disclosed below by providing a yarn tension control apparatus comprising a first feed roll having a substantially conically tapered yarn engaging roll surface, and including means for driving the first feed roll at a predetermined r.p.m., a second feed roll having a substantially conically tapered yarn engaging roll surface, the second feed roll positioned in spacedapart relation with the first feed roll for receiving a yarn wrapped successively around a circumference defined collectively by opposed surfaces of the first and second rolls from a yarn infeed position axially along the first and second rolls to a yarn exit position, and including means for driving the second feed roll.

The first and second feed rolls are aligned relative to each other so that the collectively defined circumference at any point on the yarn engaging surfaces of the first and second rolls is greater than the collectively defined circumference in one direction along the axis of rotation of the rolls, and less than the collectively defined circumference in the other direction along the axis of rotation of the rolls.

Closed loop tension feedback control means vary the rate of feed of the yarn as a function of the tension on the yarn as it exits the yarn tension control apparatus.

The feedback control means comprise an elongate tension arm positioned between and along the length of the first and second rolls, a plurality of yarn guides positioned in the tension arm along the length thereof for receiving successive wraps of yarn, and mounting means for mounting the tension arm for movement along the length of the rolls in response to changes in tension of the yarn to a yarn infeed position of increased roll diameter in response to an increase in tension on the yarn and to a position of decreased roll diameter in response to a decrease in tension on the yarn.

According to one preferred embodiment of the invention, the axis of rotation of the second feed roll is angled slightly relative to the axis of rotation of the first feed roll to provide a slightly angled normal plane of the second roll relative to the normal plane of the first roll and thereby permit spacing of the yarn along the length of the rolls from the larger circumference end of the rolls to the smaller circumfernce end of the rolls.

The tension arm includes pivot means for pivoting the tension arm relative to the axis of rotation of the first and second rolls and for moving the yarn guides longitudinally along the length of the first and second rolls.

Preferably, the pivot means pivots the tension arm from an off-center point on the tension arm closer to the yarn infeed position of the yarn on the first and second rolls.

Preferably, the yarn tension apparatus includes means for varying the resistance of the tension arm to yarn tension and thereby controlling the degree of feedback control exercised by the tension arm.

Preferably, the means for varying the resistance of the tension arm comprises a spring.

According to another preferred embodiment of the invention, the means for driving the second feed roll comprises the yarn.

An embodiment of the method according to the invention comprises the steps of providing a first feed roll having a substantially conically tapered yarn engaging roll surface for being driven at a predetermined r.p.m. and a second feed roll having a substantially conically tapered yarn engaging roll surface. The second feed roll is positioned in spaced-apart relation with the first feed roll and including means for driving the second feed roll at the same predetermined r.p.m. as the first feed roll.

The invention also includes the steps of aligning the first and second feed rolls relative to each other so that a collectively defined circumference at any point on the yarn feeding surfaces of the first and second rolls is greater than the collectively defined circumference in one direction along the axis of rotation of the rolls, and less than the collectively defined circumference in the other direction along the axis of rotation of the rolls and wrapping a yarn successively around a circumference defined collectively by the roll surfaces of the first and second rolls.

Tension is controlled by varying the position of the wraps of yarn on the first and second rolls in proportionate response to tension variations in the yarn and varying the spacing between at least some of the wraps of yarn and thereby the percentage decrease in the roll diameter of the first and second rolls at the yarn infeed position in relation to the yarn exit position to thereby vary the percentage decrease in yarn tension between the yarn infeed and yarn exit positions.

Preferably, the method includes the step of angling the second feed roll slightly relative to the axis of rotation of the first feed roll to provide a slightly different roll circumference on the second roll at the point of transfer of the yarn from the second roll to the first roll and thereby permit spacing of the yarn along the length of the rolls from the larger circumference end of the rolls to the smaller circumference end of the rolls.

According to one preferred embodiments of the invention, the step of varying the length of the rolls along which the yarn is wrapped comprises receiving the yarn from an upstream yarn source such as a creel and applying the yarn to the first and second feed rolls at a predetermined point along the yarn engaging roll surface, receiving the yarn from the feed rolls at reduced tension and delivering the yarn to a downstream yarn process, moving the predetermined point where the yarn is applied to the first and second feed rolls to a point of increased diameter in response to a increase in tension on the yarn at the exit guide, and varying the spacing between at least some of the wraps of yarn and thereby the percentage decrease in the roll diameter of the first and second rolls at the yarn infeed position in relation to the yarn exit position to thereby vary the percentage decrease in yarn tension between the yarn infeed and yarn exit positions.

BRIEF DESCRIPTION OF THE DRAWINGS

Some of the objects of the invention have been set forth above. Other objects and advantages of the invention will appear as the description of the invention proceeds when taken in conjunction with the following drawings, in which.

DESCRIPTION OF THE PREFERRED EMBODIMENT

Figure 1:
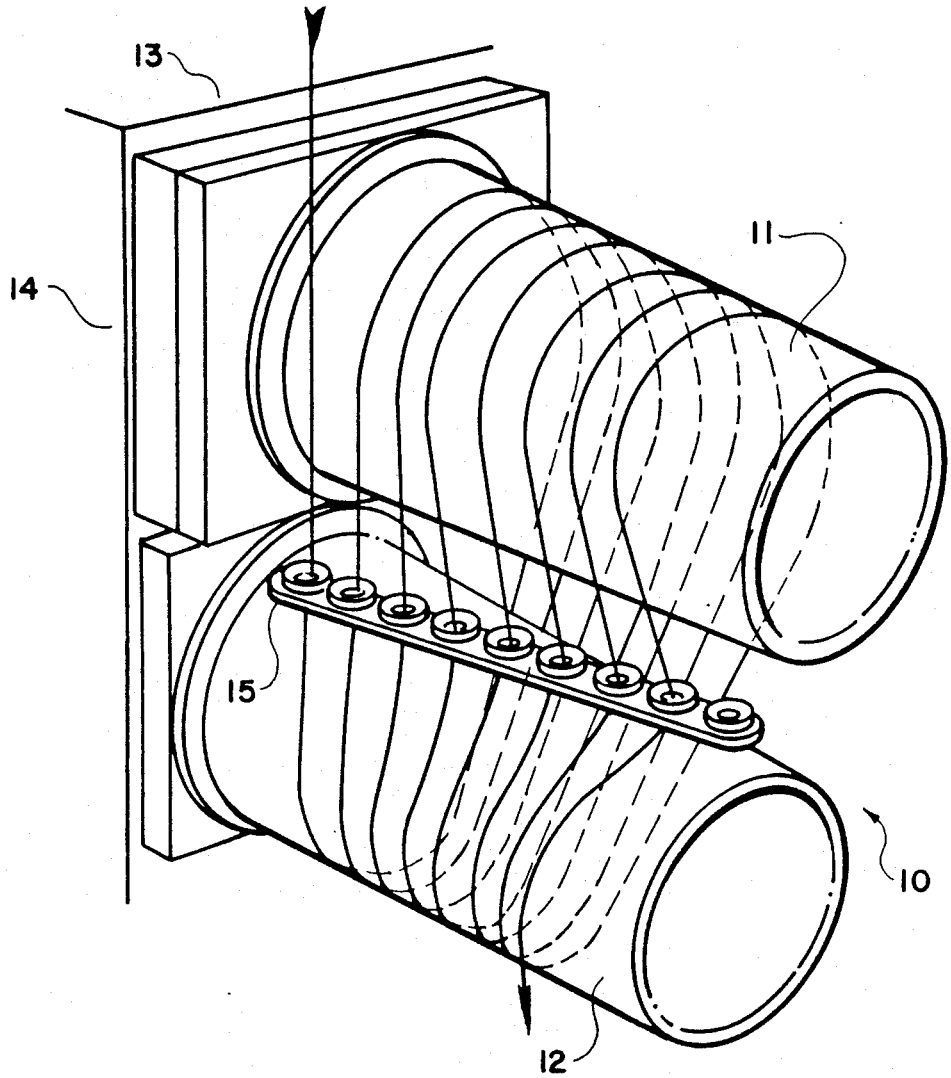
FIG. 1 is a fragmentary perspective view of an air jet texturizer, showing the yarn tension control apparatus according to an embodiment of the present invention.

Referring now specifically to the drawings, a yarn tension control appartus according to the present invention is illustrated in FIG. 1 and shown generally at reference numeral 10. Apparatus 10 has application in numerous processes where it is necessary or desirable to decrease the tension of a moving yarn before delivering it to a further processing step. In this application and for purposes of illustration, the yarn tension control apparatus 10 will be described in a process where flat continuous multi-filament synthetic yarn is delivered from an upstream creel to an air jet entanglement texturizing machine. In this type of texturizing process, it is desirable to have the tension on the yarn at a relatively low and uniform level since the process relies on the ability of the air jet to increase the bulk of the yarn by forming a multitude of random loops and tangles in the yarn, and tension resists the formation of the loops and tangles. Low tension can be easily achieved at low yarn travel speeds. However, for the process to be economically productive, the yarn must travel at a high rate of speed, therby increasing tension. Therefore, the yarn tension control apparatus 10 is interposed in the process stream between the creel and the air jet texturizer.

Still referring to FIG. 1, yarn tension control apparatus 10 comprises two spaced-apart feed rolls 11 and 12. In the particular embodiment shown in FIG. 1, both feed rolls 11 and 12 are mounted on a frame 13 and are driven through suitable power transmission means, shown generally at 14, at the same predetermined rotational speed. Alternatively, one of the rolls, usually the top roll 11, can be driven, and the bottom roll can be an idler. Both feed rolls 11 and 12 have a slightly tapered, conical yarn engaging circumference. While the degree of taper is variable, a five degree (5°) taper is suitable.

Figure 3:
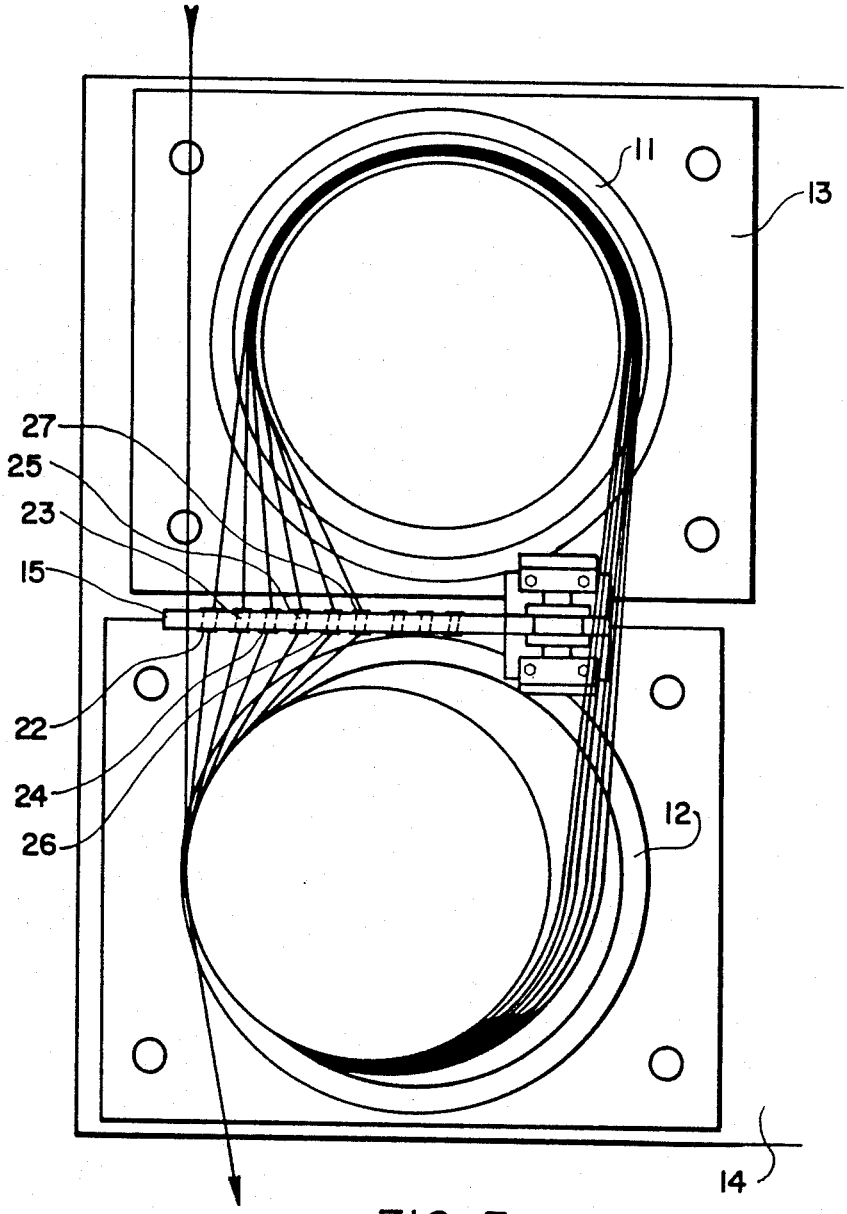
FIG. 3 is an elevation taken 90° from the view in FIG. 2, showing the yarn tension apparatus from the end of the rolls.

The axis of rotation of the bottom feed roll 12 is angled slightly, as is shown in both FIGS. 1 and 3. The effect of this is to provide on the bottom feed roll 12 a slightly greater roll circumference at the point of transfer of the yarn from the bottom roll 12 to the top roll 11, thereby spacing the yarn along the rolls 11 and 12 from left to right from an infeed position to an exit position, as shown in FIG. 1.

Enough wraps of the yarn are placed around rolls 11 and 12 so that positive feeding of the yarn is achieved. The effect of the spacing of the yarn along the length of the rolls 11 and 12 with their gradually decreasing circumferences is to decrease the rate of travel of the yarn as it moves from left to right. The reduced surface speed of the rolls 11 and 12 from left to right also reduces the speed and the tension on the yarn being positively fed by rolls 11 and 12. Tension reduction is a direct result of the decrease in elongation of the yarn as it moves along the decreasing circumferences of rolls 11 and 12. As is apparent, the alignment of the rolls 11 and 12 with each other collectively define a single circumference at any point on the yarn feeding surfaces of the rolls, with that collective circumference decreasing as the yarn travels along the rolls 11 and 12 from the end adjacent the power transmission 14 to the outer end. The reduction in elongation and therefore tension achieved in the yarn is controlled by the length of the rolls 11 and 12 along which the yarn is permitted to travel. Reduction in elongation is directly functionally related to the reduction in roll circumference. Therefore, to reduce the elongation of the yarn by 10%, the yarn will theoretically be taken off rolls 11 and 12 at a point where the circumference of the rolls is 10% less than where the yarn was put on, with allowances made for empirically determined variables such as roll slippage being taken into account.

Figure 2:
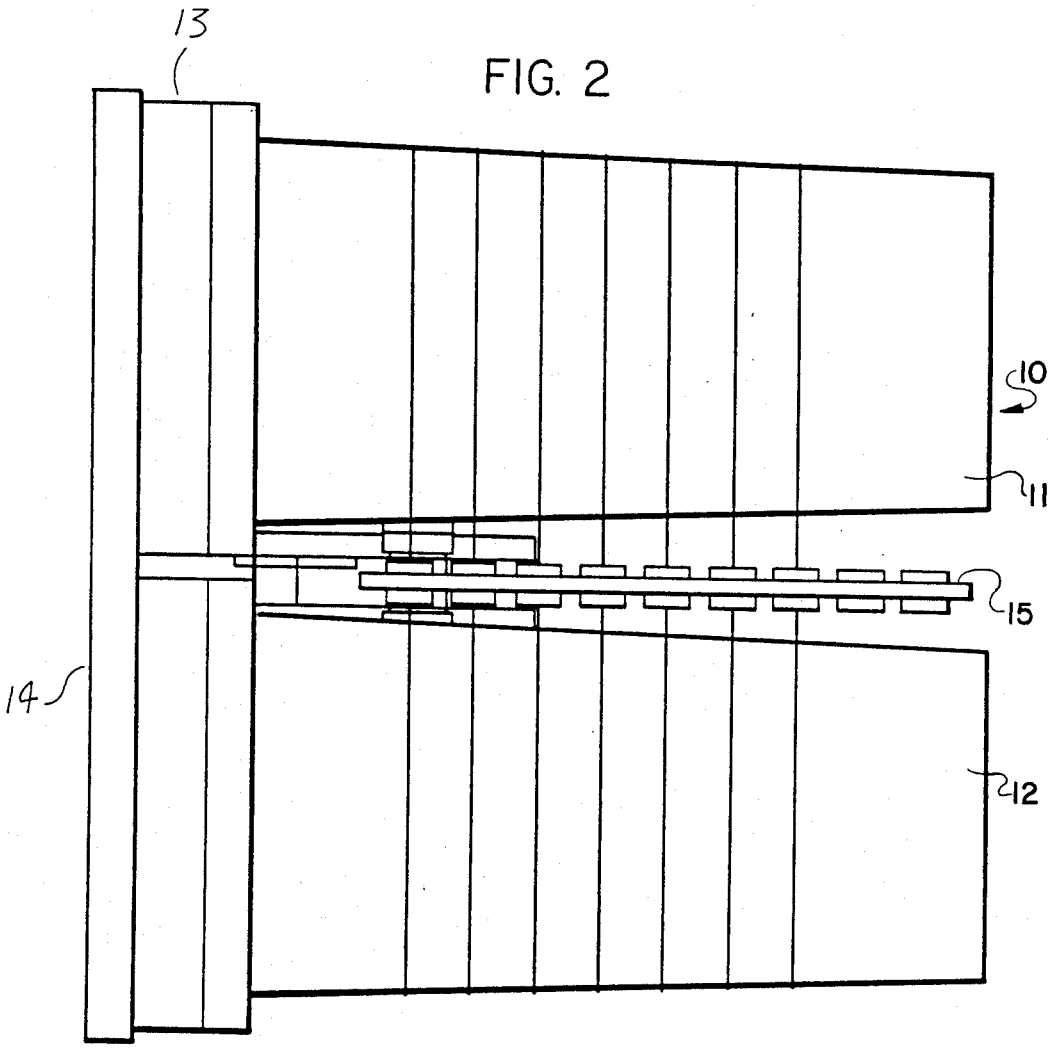
FIG. 2 is a side elevation of the yarn tension control apparatus, showing top and bottom rolls, with the tension arm positioned between them.
Figure 4:
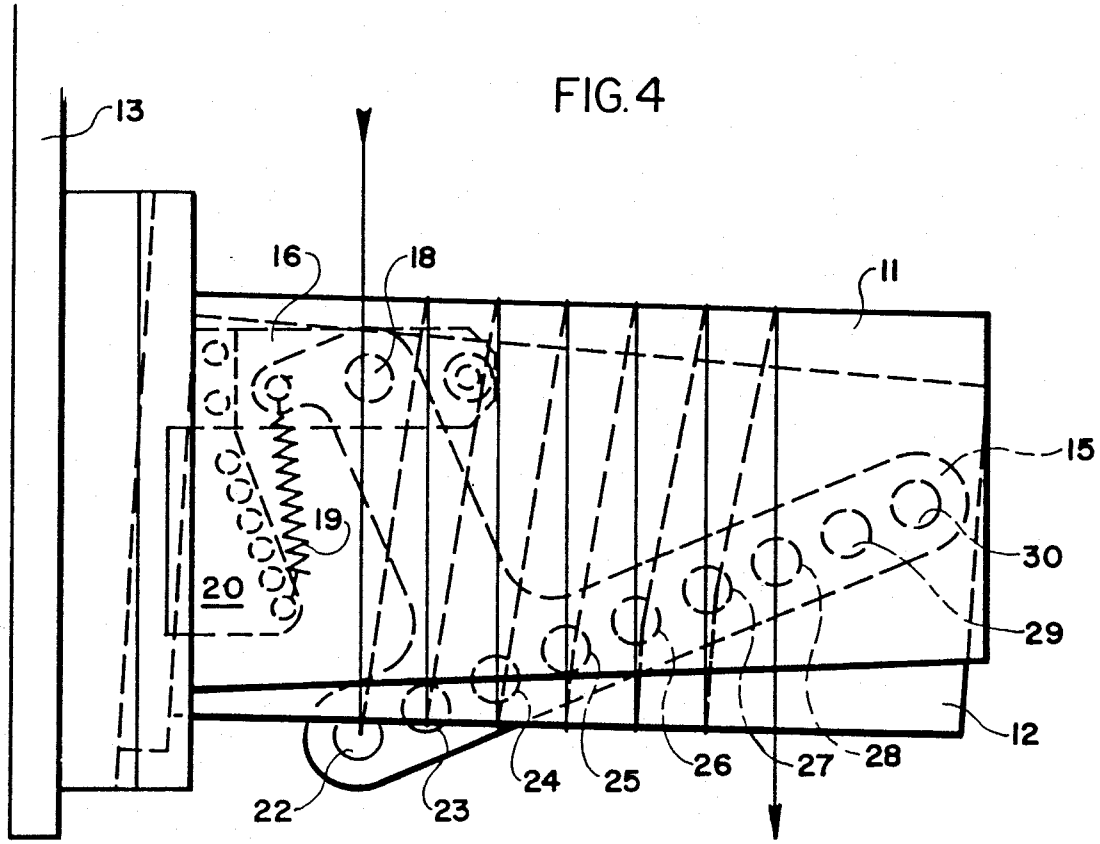
FIG. 4 is a top view of the yarn tension apparatus.

Tension control is accomplished by placing a tension arm 15 between rolls 11 and 12, as is best shown in FIGS. 1,2 and 4. Tension arm 15 is pivotally mounted on a mounting bracket 16 by means of a pin 18. Resistance by the tension arm 15 is adjusted by moving a spring 19 to a selected one of several holes in a tension adjustment bar 20. In the position shown in FIG. 4, tension arm 15 is set to its greatest degree of tension resistance.

Referring again to FIG. 1, yarn is threaded through the apparatus 10 by first passing the yarn from the creel or other upstream yarn source through the innermost yarn guide 22 in tension arm 15, around bottom roll 12, then up and counterclockwise around top roll 11 and then down through yarn guide 23. The process is repeated for as many times as is necessary to achieve positive feeding of the yarn by rolls 11 adn 12. Typically, this is at least 3 but as many as 7 or 8 wraps of the yarn around rolls 11 and 12. After exiting outermost of the yarn guides in use (yarn guide 27 in FIG. 4) the yarn proceeds under lowered, uniform tension to the air jet or other downstream processing (not shown).

Figure 5:
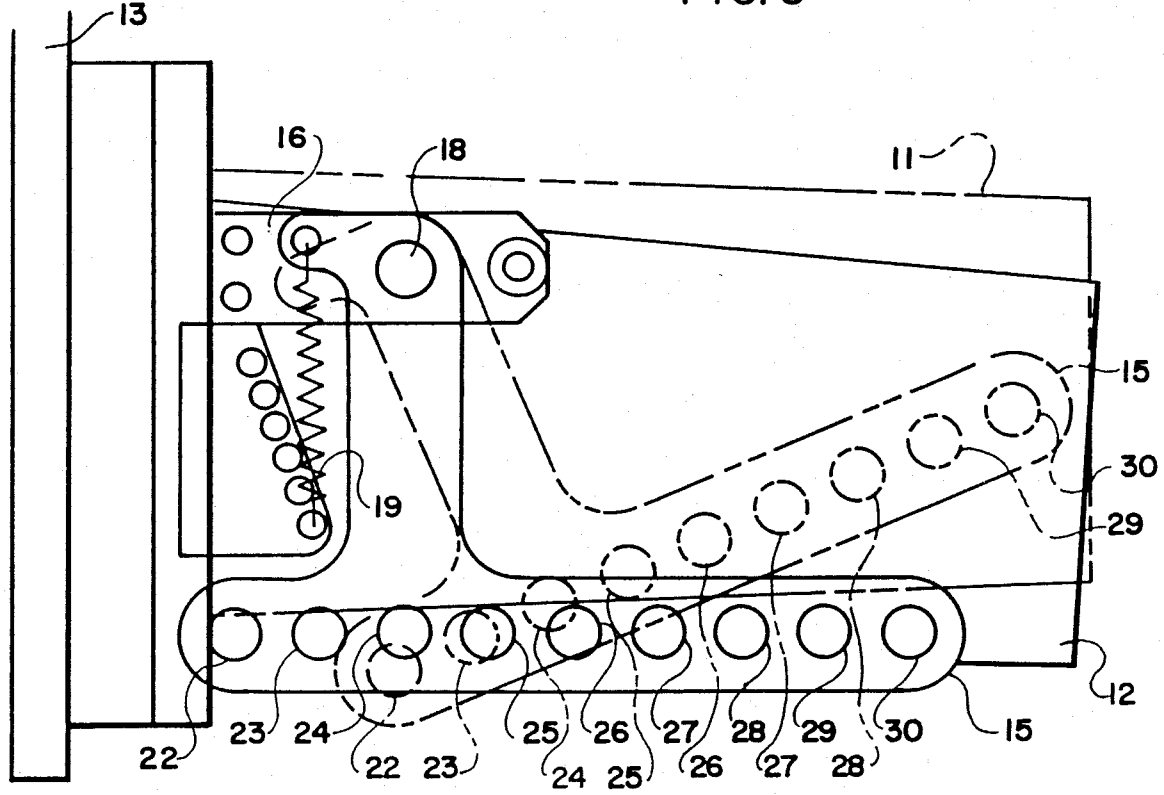
FIG. 5 is a view according to FIG. 4, and showing the increasing rate of yarn displacement towards the end of the tension arm away from the pivot point.

Yarn tension causes tension arm 15 to pivot from an "at rest", tensionless position at its most counterclockwise position (in phantomn lines) into a position more parallel to the longitudinal axis of rolls 11 and 12, as is shown schematically in FIG. 5 (solid lines). Variations in tension cause tension arm 15 to pivot around pin 18. This pivoting motion of tension arm causes the yarn guides 22–30 to move back and forth along the length of rolls 11 and 12.

Figure 6:
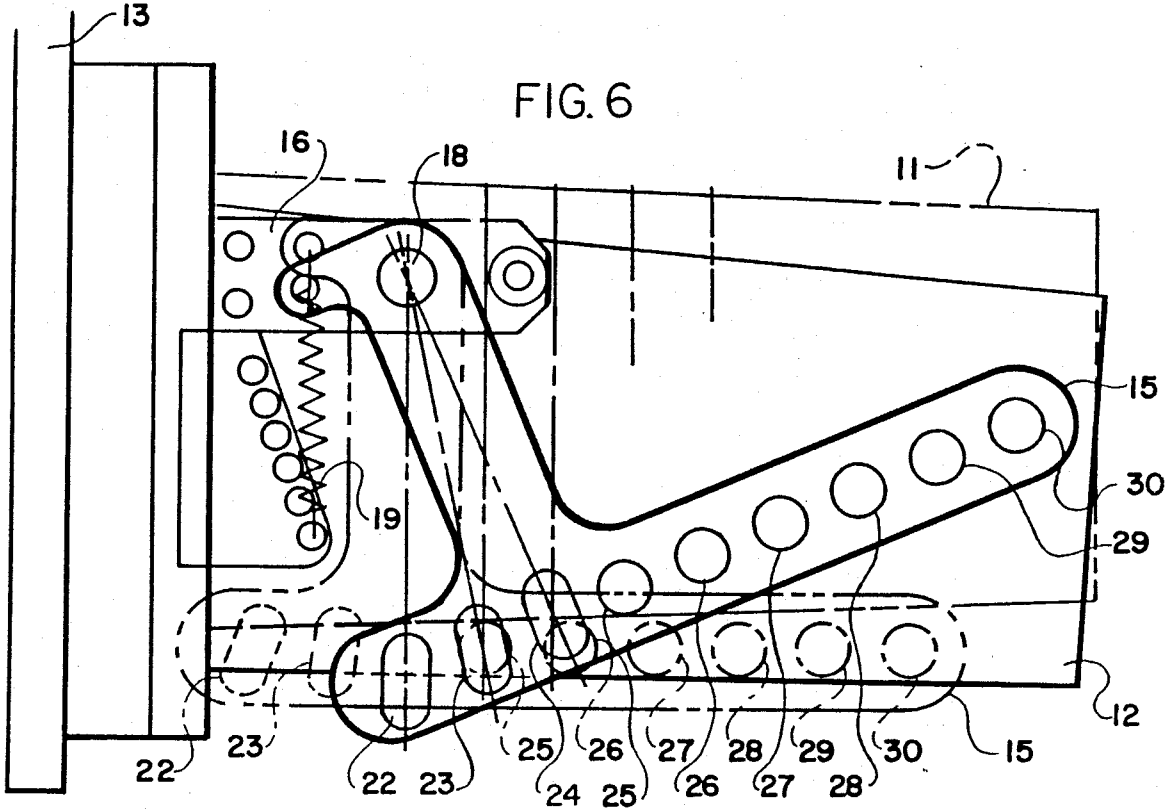
FIG. 6 is a top view of another embodiment of the yarn tension apparatus.

Referring to FIG. 6, the design and placement of the tension arm 15 has been selected to achieve several requirements. Tension variation of the first few wraps of yarn from the infeed position and through yarn guides 22, 23 and 24 have practically no influence on the position of tension arm 15. The yarn guides 22, 23 and 24 are elongated along an axis in line with the pivot axis of tension arm 15. The infeed yarn is so nearly in line with the pivot axis that little torque is created by tension variations. Therefore, the infeed position of the yarn changes very little in this condition.

On the other hand, tension variations in the last few yarn guides, for example 26–30, have the greatest effect on the position of the tension arm because of the leverage exerted by the yarn at the substantially offset position from the pivot pin 18. The effect of yarn tension on tension arm 15 become progressively less from yarn guide 30 towards yarn guide 22. This effectively biases the operation of the yarn tension apparatus in such a way as to insure that yarn exiting rolls 11 and 12 are at a predetermined low level of tension. Lower tension on the yarn at the exit point to the right of yarn guide 26 allows the tension arm 15 to move counterclockwise, shifting the infeed wraps of yarn to the right onto a smaller diameter area of rolls 11 and 12, and the lower feeding rate will increase the output tension.

Conversely, higher tension on the yarn at the exit point pulls the tension arm 15 clockwise, shifting the infeed wraps of yarn to the left onto a larger diameter area of rolls 11 and 12, and the higher feeding rate will decrease the output tension. The effect of tension variation in the first few yarn guides can be nullified altogether by replacing the round yarn guides 22–24 with radial slots (not shown).

While the rolls 11 and 12 as shown in the drawings are linearly tapered, this need not be the case. An increasingly tapered pair of rolls would permit a different tension arm arrangement wherein the effect of tension along the length of the rolls is more uniform. The important point is thaqt the input tension is less important than the output tension and that the apparatus must be designed to place greater emphasis on correcting tension of the yarn as it approaches the exit point.

A method and apparatus for controlling yarn tension is described above. Various details of the invention may be changed without departing from its scope. Furthermore, the foregoing description of the preferred embodiment according to the present invention is provided for the purpose of illustration only and not for the purpose of limitation—the invention being defined by the claims.

I claim:

1. A yarn tension control apparatus, comprising:

(a) a first feed roll having a substantially conically tapered yarn engaging roll surface;

(b) a second feed roll having a substantially conically tapered yarn engaging roll surface, said second feed roll positioned in spaced-apart relation with said first feed roll for receiving a yarn wrapped successively around a circumference defined collectively by opposed surface of said first and second rolls from a yarn infeed position to a yarn exit position, and including means for driving at least one of said first feed roll and said second feed roll;

(c) said first and second feed rolls being aligned relative to each other so that the collectively defined circumstances at any point on the yarn engaging surfaces of said first and second rolls is greater than the collectively defined circumference in one direction along the axis of rotation of the rolls, and less than the collectively defined circumference in the other direction along the axis of rotation of the rolls; and (d) closed loop tension feedback control means for varying the rate of feed of the yarn as a function of the tension on the yarn as it exits the yarn tension control apparatus, said feedback control means comprising:

(i) An elongate tension arm positioned between and along the length of said first and second rolls;

(ii) a plurality of yarn guides positioned in said tension arm along the length thereof for receiving successive wraps of yarn; and (iii) mounting means for mounting said tension arm for movement of said yarn guides along the length of the rolls in response to changes in tension of the yarn to a yarn infeed position of decreased roll diameter in response to an increase in tension on the yarn and to a position of increased roll diameter in response to a decrease in tension on the yarn.

2. A yarn tension control apparatus according to claim 1, wherein the axis of rotation of said second feed roll is angled slightly relative to the axis of rotation of said first feed roll to provide a slightly angled normal plane of the said second roll relative to the normal plane of the said first roll and thereby permit spacing of the yarn along the length of the rolls from the larger circumference end of the rolls to the smaller circumference end of the rolls.

3. A yarn tension control apparatus according to claim 1 or 2, wherein said mounting means for mounting said tension arm includes pivot means for pivoting said tension arm relative to the axis of rotation of said first and second rolls and for moving the yarn guides longitudinally along the length of said first and second rolls.

4. A yarn tension control apparatus according to claim 3, wherein pivot means pivots said tension arm from an off-center point on said tension arm closer to the yarn infeed position of the yarn on said first and second rolls.

5. A yarn tension control apparatus according to claim 4, and including means for varying the resistance of the tension arm to yarn tension and thereby controlling the degree of feedback control exercised by the tension arm.

6. A yarn tension control apparatus according to claim 5, wherein said means for varying the resistance of the tension arm comprises a spring.

7. A yarn tension control apparatus according to claim 1, wherein said second feed roll comprises an idler roll for being driven by the yarn.

8. A yarn tension control apparatus, comprising:

(a) a first feed roll having a substantially conically tapered yarn engaging roll surface, and including means for driving said first feed roll at a predetermined r.p.m.;

(b) a second feed roll having a substantially conically tapered yarn engaging roll surface, said second feed roll positioned in spaced-apart relation with said first feed roll for receiving a yarn wrapped successively around a circumference defined collectively by opposed surfaces of said first and second rolls from a yarn infeed position to a yarn exit position, and including means for driving said second feed roll;

(c) said first and second feed rolls being aligned relative to each other so that the collectively defined circumstances at any point on the yarn engaging surfaces of said first and second rolls is greater than the collectively defined circumstances in one direction along the axis of rotation of the rolls, and less than the collectively defined circumstances in the other direction along the axis of rotation of the rolls; and (d) closed loop tension feedback control means for varying the rate of feed of the yarn as a function of the tension on the yarn as it exists the yarn tension control apparatus, said feedback control means comprising:

(i) an elongate tension arm positioned between and along the length of said first and second rolls, (ii) a plurality of yarn guides positioned in said tension arm along the length thereof for receiving successive wraps of yarn; and (iii) mounting means for mounting said tension arm for movement of said yarn guides along the length of the rolls in response to changes in tension of the yarn to a yarn infeed position of increased roll diameter in response to an increase in tension on the yarn and to a position of decreased roll diameter in response to a decrease in tension on the yarn, said movement means having a component of movement of the yarn along the length of the rolls responsive to tension variations which increase progressively along the length of the rolls from the infeed position to the exit position for providing greater correction in response to tension variations the closer the wrap of yarn exhibiting the tension variation resides to the exit position of the yarn.

9. A method of controlling yarn tension, comprising the steps of:

(a) providing a first feed roll having a substantially conically tapered yarn engaging roll surface for being driven at a predetermined r.p.m.;

(b) providing a second feed roll having a substantially conically tapered yarn engaging roll surface, said second feed roll positioned in spaced-apart relation with said first feed roll and including means for driving said second feed roll at the same predetermined r.p.m. as said first feed roll;

(c) aligning said first and second feed rolls relative to each other so that a collectively defined circumference at any point on the yarn feeding surfaces of said first and second rolls is greater than the collectively defined circumference in one direction along the axis of rotation of the rolls, and less than the collectively defined circumference in the other direction along the axis of rotation of the rolls;

(d) wrapping a yarn successively around a circumference defined collectively by the roll surfaces of said first and second rolls;

(e) varying the position of the wraps of yarn on the first and second rolls in proportionate response to tension variations in the yarn; and (f) varying the spacing between at least some of the wraps of yarn and thereby the percentage decrease in the roll diameter of the first and second rolls at a yarn infeed position of said first and second rolls in relation to a yarn exit position of said first and second rolls to thereby vary the percentage decrease in yarn tension between the yarn infeed and yarn exit positions.

10. A method of controlling yarn tension according to claim 9, and including the step of angling the second feed roll slightly relative to the axis of rotation of said first feed roll to provide a slightly different roll circumference on said second roll at the point of transfer of said yarn from said second roll to said first roll and thereby permit spacing of the yarn along the lenght of the rolls from the larger circumference end of the rolls to the smaller circumference end of the rolls.

* * * * *